US006862826B2

(12) United States Patent
Lowry et al.

(10) Patent No.: US 6,862,826 B2
(45) Date of Patent: Mar. 8, 2005

(54) LABEL HOLDER WITH LOCKING WINDOW

(75) Inventors: Michael G. Lowry, Boca Raton, FL (US); Robert Fast, Ft. Lauderdale, FL (US)

(73) Assignee: Fast Industries, Ltd., Fort Lauderdale, FL (US)

( * ) Notice: Subject to any disclaimer, the term of this patent is extended or adjusted under 35 U.S.C. 154(b) by 0 days.

(21) Appl. No.: 10/216,197

(22) Filed: Aug. 12, 2002

(65) Prior Publication Data

US 2003/0080570 A1 May 1, 2003

Related U.S. Application Data

(60) Provisional application No. 60/330,766, filed on Oct. 30, 2001, now abandoned.

(51) Int. Cl.[7] ..... G09F 3/20

(52) U.S. Cl. ..... 40/649; 40/653; 40/661; 40/661.06; 40/661.08

(58) Field of Search ..... 40/649, 651, 653, 40/654.01, 655, 661, 661.03, 661.06, 661.08

(56) References Cited

U.S. PATENT DOCUMENTS

| | | | | | |
|---|---|---|---|---|---|
| 4,745,695 | A | * | 5/1988 | Hetzer | 40/661 |
| 4,866,868 | A | * | 9/1989 | Kass | 40/661 |
| 5,392,547 | A | * | 2/1995 | Mason | 40/661.06 |
| 5,515,632 | A | | 5/1996 | Gebka et al. | |
| 6,026,603 | A | | 2/2000 | Kump et al. | |
| 6,035,569 | A | | 3/2000 | Nagel et al. | |
| 6,082,687 | A | | 7/2000 | Kump et al. | |
| 6,119,990 | A | | 9/2000 | Kump et al. | |
| 6,568,113 | B1 | * | 5/2003 | Valiulis | 40/661.06 |

FOREIGN PATENT DOCUMENTS

| | | |
|---|---|---|
| DE | 87 09 128 U | 10/1987 |
| DE | 94 05 498 U | 9/1994 |

* cited by examiner

*Primary Examiner*—Gary C. Hoge
(74) *Attorney, Agent, or Firm*—Jacobson Holman PLLC

(57) ABSTRACT

A label holder including a transparent cover member overlying a label-receiving pocket with complementary male and female locking elements snappingly engageable with each other to selectively secure the pocket, and a release element to disengage the locking elements.

8 Claims, 2 Drawing Sheets

LABEL HOLDER WITH LOCKING WINDOW

This is a complete application claiming benefit of provisional application Ser. No. 60/330,766, filed Oct. 30, 2001 now abandoned.

BACKGROUND OF THE INVENTION

1. Field of the Invention

This invention relates to plastic price channels of the kind used, for example, with merchandise display shelves in retail outlets such as supermarkets, drug stores, or the like, to receive labels providing information relating to merchandise being displayed on the shelves. More specifically, this invention is directed to a label holder with a locking transparent window or cover member of the type shown in commonly owned U.S. Pat. No. 5,515,632 issued May 14, 1996, the subject matter of which is incorporated herein in its entirety by reference (the '632 patent)

2. Description of the Related Art

In the '632 patent, the transparent cover member of a plastic label holder is hingedly and resiliently secured to the bottom of a main body panel to form a pocket between them for reception of a paper label or the like. The cover member has a height such that its top edge is releasably engaged or "locked" behind a downwardly extending lip on the top of the main body panel. A forwardly extending channel-shaped formation is provided along the top edge of the cover, comprising an inner downwardly extending limb and an outer upwardly extending limb between which the top lip of the main body panel is received when the cover is "locked" in position. The outer limb forms a gripping element by which the top edge of the cover can be disengaged from behind the top lip by finger pressure exerted from above, downwardly and outwardly on the upper edge of the outer limb. The construction of the '632 patent is inexpensive to manufacture and efficient in use. However, for certain applications it may be desirable to provide means that directly and releasably secure the cover to the main body panel minimizing the entry of dust and other extraneous matter and providing a more secure engagement between the elements.

SUMMARY OF THE INVENTION

It is a primary object of this invention to provide a variety of locking mechanisms for releasably securing the top edge of the cover member of a plastic price channel of the type described above to the top of the main body portion to secure a paper label or the like in a pocket formed between the main body portion and the cover member, with an integral gripping element on the cover member which facilitates release of the locking mechanism when access is required to the label-receiving space behind the cover member.

More generally, this invention is directed to the provision of cooperative locking elements on the juxtaposed front surface of the main body panel and rear surface of the transparent cover of a label holder which can be readily engaged and disengaged repeatedly without damage to the product.

Other and further objects, features and advantages of the invention will become apparent from the ensuing description and claims taken in conjunction with the attached drawings.

BRIEF DESCRIPTION OF THE DRAWINGS

Like reference characters refer to like parts throughout the several views of the drawings.

DESCRIPTION OF THE PREFERRED EMBODIMENTS

Figure 1A:
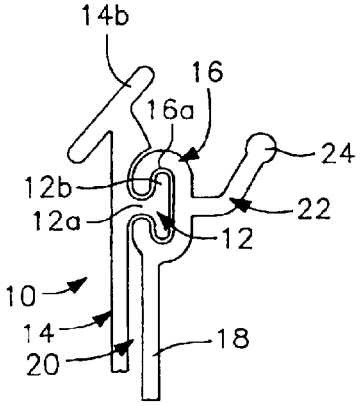
FIGS. 1A–1C, 2A–2C and 3A–3C are fragmentary side elevational views of a multiplicity of embodiments of locking and releasing mechanisms for a label holder according to the instant inventive concepts.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

In the accompanying drawings, FIG. 1A show an embodiment of a price channel 10 wherein an integral, generally "T-shaped", male element 12, comprising a generally horizontally extending stem 12*a* and a generally vertically extending cross-bar 12*b*, is formed on the front surface of the main body panel 14 adjacent the upper edge thereof. A complementary female element 16 is formed on the upper edge of the rear surface of the transparent cover member 18 and defines a channel 16*a* complementary to the cross-bar 12*b* of the male element 12. The plastic material from which these elements are manufactured can be the same or similar to those used to form the label holder in the '632 patent, and are sufficiently resilient that the channel 16*a* of the female element 16 can be snappingly engaged over the cross-bar 12*b* of the T-shaped male element 12 to lock the cover member 18 to the main body panel 14 to retain a label or the like (not shown) in the pocket 20 formed therebetween.

In the embodiment of FIG. 1A, the release element is an outwardly and upwardly extending limb 22, which may be formed with an enlarged protrusion or knob 24 on its end to facilitate releasing the engagement between elements 16 and 12 by finger pressure exerted from above, downwardly and outwardly on the upper edge or knob 24 of the limb 22.

Figure 1B:
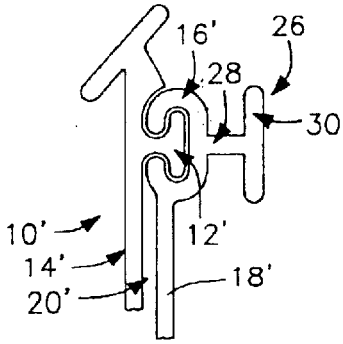

In the embodiment shown in FIG. 1B, parts similar to the embodiment of FIG. 1A are marked with the same reference numerals followed by a prime (′). The release element 26 in this embodiment is a T-shaped element with an outwardly extending leg 28 terminating in a vertically extending bar 30.

Figure 1C:
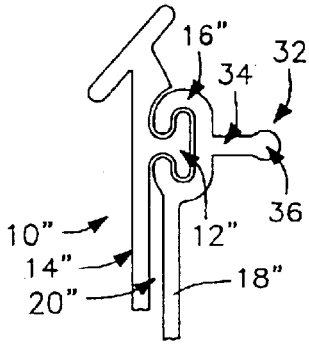

In FIG. 1C, wherein parts similar to FIG. 1A are designated by a double prime (″), the finger-engaging release element 32 has an outwardly extending portion 34, and a knob or enlarged protrusion 36, at its outer end.

Figure 2A:
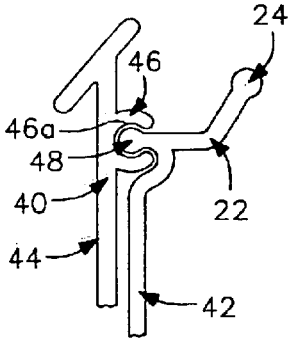
Figure 2B:
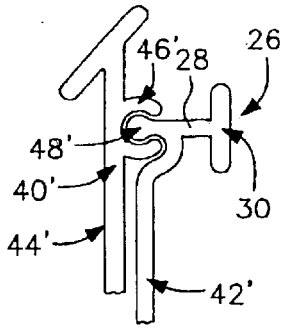
Figure 2C:
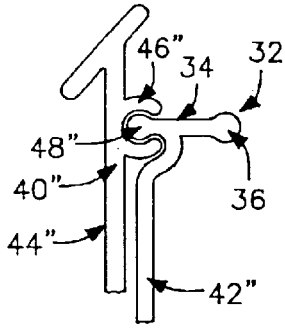

In the embodiments of FIGS. 2A, 2B and 2C, wherein similar designations are used, the main body panel and transparent cover member 40, 42 of the label holder 44, are connected by, effectively, a reverse arrangement of elements similar to those of the embodiments shown in FIGS. 1A, 1B and 1C, respectively. In this instance, the female element 46 is formed on the main body panel 40 and defines a generally C-shaped internal channel 46*a*. The upper end of the cover member 42 has an inwardly extending portion terminating in an enlarged protrusion or male element 48 for resilient interengagement with the channel 46*a*. The release elements are similar to those seen in FIGS. 1A, 1B and 1C, respectively, and bear the same reference characters.

Figure 3A:
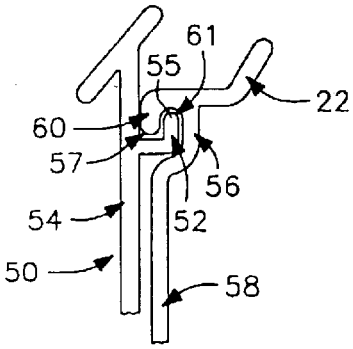
Figure 3B:
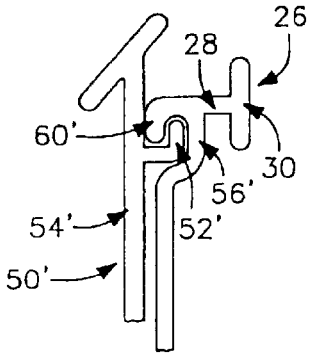
Figure 3C:
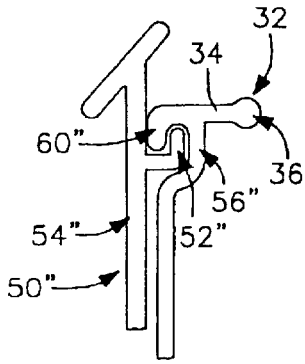

In the embodiments of the label holder 50 seen in FIGS. 3A, 3B and 3C, an L-shaped element 52 extends outwardly and upwardly from the main body panel 54 terminating in a finger 55 and forming an upwardly opening pocket 57 between the finger 55 and the front surface of the main body panel 54. An element 56 on the cover member 58 extends inwardly and around the finger 55 terminating in a downwardly depending finger 60 engaged in the pocket 57 and, together with the rear surface of the cover member 58 defining a downwardly opening pocket 61 receiving the finger 55. Again, the release elements are similar to those of FIGS. 1A, 1B and 1C.

Obviously, the various embodiments of engaging and disengaging elements and cover elements shown herein can be integrated into a single label holder. Moreover, other similar locking elements and release elements will be readily recognized by those skilled in this art and are to be included within the instant inventive concepts.

Figure 4:
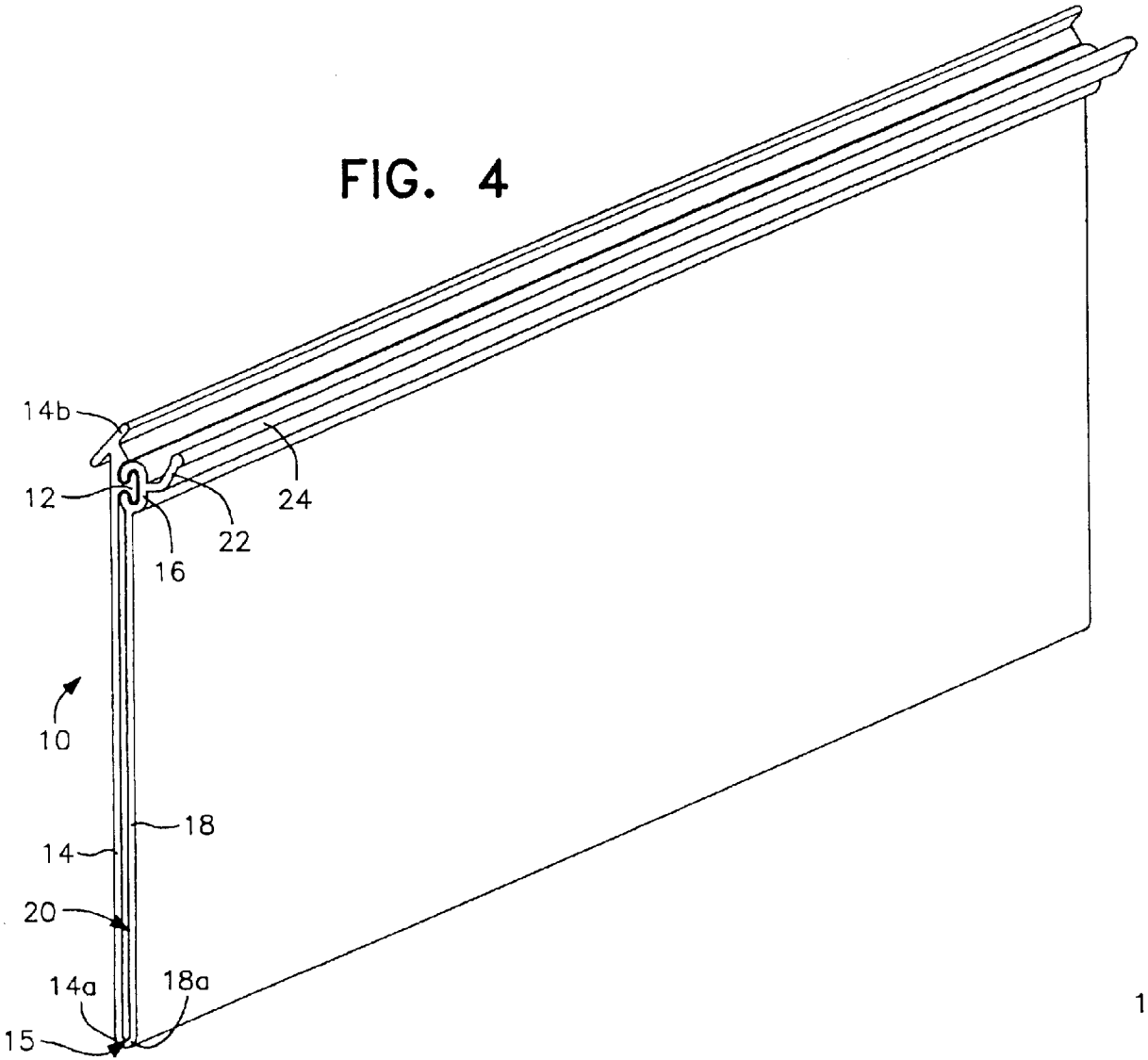
FIG. 4 is a perspective view of one form of label holder having the locking and releasing mechanism of FIG. 1A.

Further details of a label holder 10 with the locking and releasing elements of FIG. 1A are seen in FIG. 4 as illustrative. In this embodiment, the bottom edge 14*a* of the main body panel and the bottom edge 18*a* of the transparent cover member are integrally or co-extruded to form a resilient bight or hinge connection 15 enabling the cover member to be tipped forwardly for access to the pocket 20 to insert or remove a paper or plastic label (not shown) when the male and female elements 12, 16 are disengaged, while biasing the upper portions of the cover member 18 toward the main body panel 14. The male and female elements 12, 16 and the release element 22 are shown as extending along the full length of the label holder 10, an arrangement that is most convenient for extrusion of these elements and provides the best sealing between the cover member and main body panel. However, it is to be understood that the instant inventive concepts are intended to cover constructions in which these elements are discontinuous.

Figure 5:
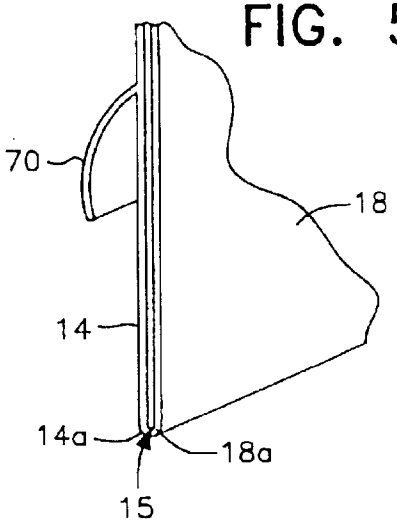
FIG. 5 is a partial fragmentary perspective view of a portion of a label holder such as seen in FIG. 4 showing a rearwardly depending leg for engagement in the lower lip of a C-channel on a merchandise shelf.
Figure 6:
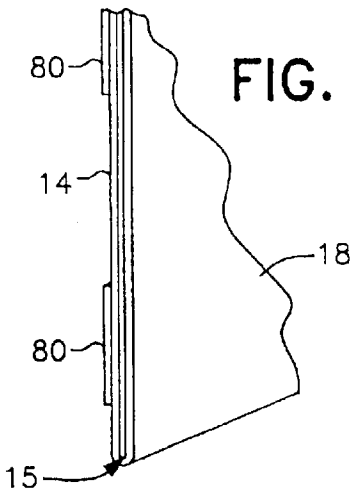
FIG. 6 is a partial fragmentary perspective view of an alternative label holder embodiment utilizing stripes of adhesive to secure the same to a supporting surface.

The means for engaging any of the label holder embodiments of this invention in a C-channel on a shelf or attaching the same to other surfaces can be similar to those described in the '632 patent and other well-known prior art label holders. For example, the barb 14*b* at the top edge of the main body panel 14 of the label holder 10 can be engaged in the downwardly depending lip at the top of a C-channel on the front of a merchandise shelf (not shown), with any mechanism, such as the downwardly depending element 72 shown on the back of the main body panel 14 in FIG. 5 engaged in the upwardly opening lip at the bottom of such a C-channel in a well known manner. Alternatively, as shown in FIG. 6, adhesive strips 80 can simply be provided on the rear surface of the main body panel to secure the label holder 10 to a supporting surface (not shown).

In summary, the mechanism for attaching the label holder to any supporting surface, whether it be a flat wall or shelf side surface, a C-channel integral with a shelf front edge, or separate therefrom, or other supporting surfaces, is not critical to the instant inventive concepts.

Moreover, any of the label holders of this invention can also be provided with an integral sign-holder (not shown) such as disclosed in co-pending application Ser. No. 10/101,726 filed Mar. 21, 2002, the subject matter of which is also incorporated herein in its entirety by reference.

The foregoing descriptions and drawings should be considered as illustrative only of the principles of the invention. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. In a plastic price channel for carrying and displaying merchandise labels, wherein the price channel comprises a main body panel having a top edge, a bottom edge, a front surface and a back surface, a transparent cover member having a top edge, a bottom edge, a front surface and a back surface, the bottom edges of the main body panel and the cover member being resiliently interconnected to define a hinge, a pocket being formed between the front surface of the main body panel and the back surface of the cover member for removably receiving labels to be displayed through the cover member, the improvement which comprises a male locking element integrally formed in juxtaposition to top edge portions of a supporting surface selected from the front surface of the main body panel and the back surface of the cover member, and a female element integrally formed in juxtaposition to top edge portions of the other supporting surface, said male and female elements being complementary and snappingly engageable to selectively secure said top edge portions of the cover member to said top edge portions of the main body panel, and a release element including an outwardly extending limb substantially perpendicular to said back surface of said cover member and separate from and forming no part of said snappingly engageable male and female elements, said limb integrally formed in juxtaposition to the top edge portions of the front surface of the cover member to facilitate disengaging the male and female elements.

2. The improvement of claim 1, wherein said male and female elements and said release element extend along substantially the full length of the upper edge portions of the main body panel and the cover member, respectively.

3. In a plastic price channel for carrying and displaying merchandise labels, wherein the price channel comprises a main body panel having a top edge, a bottom edge, a front surface and a back surface, a transparent cover member having a top edge, a bottom edge, a front surface and a back surface, the bottom edges of the main body panel and the cover member being resiliently interconnected to define a hinge, a pocket being formed between the front surface of the main body panel and the back surface of the cover member for removably receiving labels to be displayed through the cover member, the improvement which comprises a male locking element integrally formed in juxtaposition to top edge portions of a supporting surface selected from the front surface of the main body panel and the back surface of the cover member, and a female element integrally formed in juxtaposition to top edge portions of the other supporting surface, said male and female elements being complementary and snappingly engageable to selectively secure said top edge portions of the cover member to said top edge portions of the main body panel., wherein said male element is generally "T"-shaped and comprises a stem portion extending generally horizontally from its supporting surface with a generally vertically extending cross-bar at its terminus, and said female element defines an internal channel complementary to said cross-bar of said male element, and a release element including an outwardly and upwardly extending limb integrally formed in juxtaposition to the top edge portions of the front surface of the cover member to facilitate disengaging the male and female elements.

4. The improvement of claim 1 wherein said male element is bulbous and said female element defines a cup-shaped channel complementary thereto.

5. The improvement of claim 1 wherein said male and female elements include oppositely directed fingers which together with their respective supporting surfaces define oppositely-directed pockets, said fingers of each said element being engageable in the pocket defined by the other element.

6. The improvement of claim 3, wherein said male and female elements and said release element extend along substantially the full length of the upper edge portions of the main body panel and the cover member, respectively.

7. The improvement of claim 1 wherein said outwardly extending limb is integral with and extends from said male or female element that is integrally formed with said cover member.

8. In a plastic price channel for carrying and displaying merchandise labels, wherein the price channel comprises a main body panel having a too edge a bottom edge, a front surface and a back surface, a transparent cover member having a top edge, a bottom edge, a front surface and a back surface, the bottom edges of the main body panel and the cover member being resiliently interconnected to define a hinge, a pocket being formed between the front surface of the main body panel and the back surface of the cover member for removably receiving labels to be displayed through the cover member, the improvement which comprises a male locking element integrally formed in juxtaposition to top edge portions of a supporting surface selected from the front surface of the main body panel and the back surface of the cover member, and a female element integrally formed in juxtaposition to top edge portions of the other supporting surface, said male and female elements being complementary and snappingly engageable to selectively secure said top edge portions of the cover member to said top edge portions of the main body panel, and a release element including an outwardly and upwardly extending limb separate from and forming no part of said snappingly engageable male and female elements, said limb integrally formed in juxtaposition to the top edge portions of the front surface of the cover member to facilitate disengaging the male and female elements wherein said outwardly and upwardly extending limb has a portion that is substantially perpendicular to said back surface of said cover member.

* * * * *